US006037585A

United States Patent [19]

Gadeken

[11] Patent Number: 6,037,585

[45] Date of Patent: Mar. 14, 2000

[54] DETERMINATION OF RADIOACTIVE SCALE DISTRIBUTION USING GAMMA RAY LOGGING TECHNIQUE

[75] Inventor: Larry L. Gadeken, Houston, Tex.

[73] Assignee: Halliburton Energy Services, Inc., Houston, Tex.

[21] Appl. No.: 08/959,436

[22] Filed: Oct. 28, 1997

[51] Int. Cl.[7] ..... G01V 5/06

[52] U.S. Cl. ..... 250/262; 250/260

[58] Field of Search ..... 250/260, 262

[56] References Cited

U.S. PATENT DOCUMENTS

| | | | |
|---|---|---|---|
| 4,527,058 | 7/1985 | Smith, Jr. . | |
| 4,542,292 | 9/1985 | Ellis . | |
| 4,717,825 | 1/1988 | Smith, Jr. et al. | 250/256 |
| 4,825,071 | 4/1989 | Gadeken et al. . | |
| 4,825,073 | 4/1989 | Smith, Jr. et al. | 250/260 |
| 4,939,361 | 7/1990 | Smith, Jr. et al. | 250/260 |
| 5,001,342 | 3/1991 | Rambow . | |
| 5,410,152 | 4/1995 | Gadeken . | |
| 5,578,820 | 11/1996 | Gadeken et al. . | |

*Primary Examiner*—Constantine Hannaher
*Attorney, Agent, or Firm*—Conley, Rose & Tayon, P.C.

[57] ABSTRACT

A method for calculating the position and quantity of scale downhole, while avoiding the need to run a before log is provided. The method includes assessing the gamma ray spectra of both scale and tracers in a single logging pass. A matrix of multipliers for both borehole and formation radium is included in the data used to evaluate the gamma ray log. The radium in the formation is distinguished from radium near the borehole (scale) using the deflection of the relative distance curve and the resulting calculations of gamma ray energy attributable to scale are used to correct the measured gamma ray emissions attributed to the tracers. The method allows several tracers to be monitored with a single logging pass, even in a hole that has been previously produced and has been contaminated with radioactive scale.

14 Claims, 3 Drawing Sheets

DETERMINATION OF RADIOACTIVE SCALE DISTRIBUTION USING GAMMA RAY LOGGING TECHNIQUE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to techniques for detecting the presence of radioactive scale in a well without running a log prior to the placement of radioactive tracers in the well. More specifically, the present invention involves a technique for using the gamma ray spectral signature of the scale to determine the position and quantity of the scale.

The art of pumping various fluids and solids downhole is well known. The objective is to place them in the formation so as to enhance stimulation and/or completion of a well. In many instances, the materials placed downhole are tagged with one or more radioactive isotopes that emit gamma rays. The radioactivity of these elements allows their presence to be detected and for this reason these isotopes are commonly referred to as tracers. The isotopes that are most commonly used as tracers are iridium ($^{192}$Ir), antimony ($^{124}$Sb), gold ($^{198}$Au), iodine ($^{131}$I), and scandium ($^{49}$Sc).

By tagging the materials that are pumped into the formation with one or more of these tracers, it is possible to monitor the placement of the materials using a gamma ray spectroscopy tool. Such a tool measures the gamma ray spectra at a sequence of depths along the borehole and uses the measured spectra to determine the locations of the individual tracers. The gamma ray data contain information regarding the radial distributions of the tagged materials as well as the variation of isotope concentration with depth. Because current technology allows the simultaneous detection of one or more tracer isotopes with distinct gamma ray signatures as well as the natural gamma ray background, several materials or stages of an operation can be separately tagged and subsequently evaluated with a single pass of a logging tool. For this reason, gamma ray spectroscopy has gained wide acceptance in the industry.

Commonly, gamma ray spectroscopy tools utilize a weighted least squares (WLS) algorithm in conjunction with a matrix of multipliers that is provided from previous calibration runs and which may be adjusted for each particular well. Full details on the operation of a gamma ray spectroscopy logging tool and the calculations used therein are set out in *Applications of the Compensated Spectral Natural Gamma Tool*, Gadeken et al., SWPLA Twenty-fifth Annual Logging Symposium, Jun. 10–13, 1984, and in *Calibration and Analysis of Borehole and Formation Sensitivities for Gamma Ray Spectroscopy Measurements with Multiple Radioactive Tracers*, Gadeken et al., The Log Analyst, May–June 1988, vol.29, No.3, pp.159–176, both of which are incorporated in their entireties herein.

Because the uses of gamma ray spectroscopy include evaluation of stimulation operations in wells that have previously been in operation, the presence of radioactive scale in the downhole tubing frequently complicates the measurement and analysis of tracer radiation. Radioactive scale typically forms on tubulars in the hole as a result of the reduction in temperature and pressure associated with production. Prior to drilling and production of a well, radium isotopes resulting from natural decay processes ($^{226}$Ra and $^{228}$Ra) and their daughter elements exist in solution in the formation water at the elevated temperature and pressure. Production of the well decreases the temperature and pressure on the fluids in the formation, causing many of the dissolved minerals to precipitate out. The material deposited on the downhole equipment as a result of this precipitation is called scale. The scale accumulated in production equipment typically contains radium co-precipitated in barium sulfate ($BaSO_4$).

Scales accumulate in tubing, separators, and other equipment. They contain a range of $Ra^{226}$ and $Ra^{228}$ concentrations, from background levels to several thousand pCi/gram (several tens of decays per minute per gram). $Ra^{226}$ forms about 78% of the total radium present as radioactive scale, while $Ra^{228}$ comprises about 22% of the total. Scale typically occurs as a very hard, monolithic precipitate, with bulk densities that range from 2–3 g/cm$^3$. If scale is removed in a disposal process, its bulk density may fall to around 1.6 g/cm$^3$, due to its high porosity, which averages about 45%.

Any radium present in scale downhole will emit gamma rays that will affect attempts to accurately measure the emission of gamma rays by the radioactive tracers in the hole. If the scale contains a significant amount of radium, the presence of scale on tubing can skew the results of gamma ray logging. In many instances, this effect can be compensated for by performing a "before log" on the hole. The measurements made during the before log are then subtracted from the log made following placement of the tracer-tagged material (the "after log") and the difference between the two logs is attributed to the placement and position(s) of the tracers-tagged material(s).

In many instances, however, it is impractical or uneconomical to perform a before log. In other instances, the value of the before log may be called into doubt, if it is suspected that the step(s) of placing the tracer-tagged material may itself cause movement of the scale, thereby reducing the accuracy of calculations that are based on the before log. Hence, it is desired to provide a technique for assessing the position and quantity of radioactive scale in the tubing without requiring the performance of a before log.

SUMMARY OF THE INVENTION

The present invention includes a method for calculating the position and quantity of scale downhole, while avoiding the need to run a before log. The present technique is useful even in a previously-produced well and includes using identifying and assessing the gamma ray spectra of both the scale and the tracers in a single logging pass. According to the present invention, a matrix of multipliers for both borehole and formation radium is included in the algorithm used to evaluate the gamma ray log. The radium in the formation is distinguished from radium near the borehole (scale) using the deflection of the relative distance curve and the resulting calculations of gamma ray energy attributable to scale are used to correct the measured gamma ray emissions attributed to the tracers.

BRIEF DESCRIPTION OF THE DRAWINGS

For a detailed description of a preferred embodiment of the invention, reference will now be made to the accompanying Figures, wherein.

DETAILED DESCRIPTION OF THE INVENTION

Logging Tool

Figure 1:
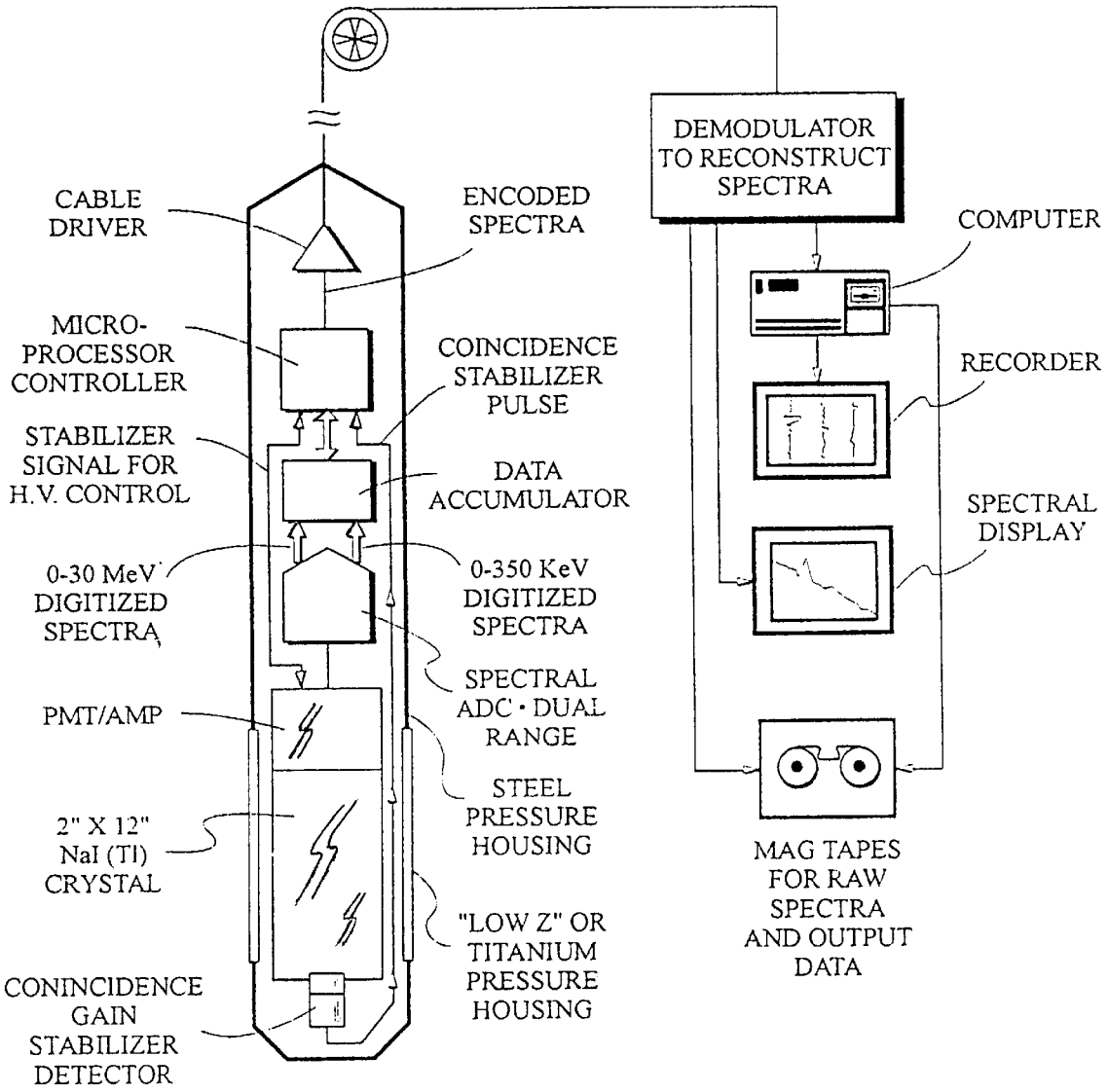
FIG. 1 is a schematic view of a spectral gamma ray logging tool.

Spectroscopic gamma ray tools are known in the art. For most logging situations, where relatively low pressures (10,000 psi)(68.95 Megapascals) and low temperatures (275° F.)(135° C.) are encountered, and where some combination applications are not essential, the preferred gamma ray spectroscopy tool incorporates a low atomic number toolcase section as shown in FIG. 1. This configuration permits measurement of more gamma rays at lower energies than conventional steel pressure housings, thus permitting more accurate diameter determinations.

The preferred logging tool may be any conventional gamma ray logging tool that transmits 768 channels of spectral data to the logging truck at the surface. The coincidence (stabilizer) events are converted into a 256 channel spectrum which spans the energy range from 0–350 keV. The anticoincidence (formation gamma radiation) events are converted into two spectra; one 256 channel spectrum spans the low energy range from 0–350 keV, the other 256 channel spectrum spans the high energy range 0–3000 keV. Both spectra are used in the present in invention.

According to a preferred embodiment, the spectra are accumulated in the tool and are transmitted to the surface computer system approximately every 0.25 feet while logging. A telemetry tape, including spectral information, is recorded at the top of the logging cable, and the two formation spectra (high energy and low energy) are then transferred to a computer. Those energy spectra are preferably broken down into a number of contiguous energy windows, some of which may be selected to encompass a peak from at least one of the isotopes that it is desired to assess.

In addition to the log curves generated in this manner, it is also possible in real-time to periodically output on a film record the actual low and high energy formation spectra (integrated over a statistically meaningful depth interval). This permits the user to visually ascertain the gain stability of the system and to ensure the absence of noise in the data.

According to one embodiment of the present method, the spectral log is run in a hole that has been cased and has already been in production for some period. This log is used in a quantitative calculation of the amount of each radioactive isotope, including radium. A preferred technique for performing this quantitative calculation is described in detail below. In a preferred embodiment, a Compton degradation measurement is simultaneously performed, yielding an assessment of the radial distribution of the isotopes detected downhole. While the present invention is most advantageous in eliminating the need to run before logs, it will be understood by those skilled in the art that the methods and techniques described herein have equal applicability in assessing the presence of radium-containing scale in a hole that has already been subjected to a before log for the same purpose.

Basic tool Response

The basic response of the gamma ray spectroscopy tools can be solved by writing the problem in matrix form as:

$$C=AM, \tag{1}$$

for which the corresponding WLS solution is (T=transpose, −1=inverse:)

$$M=(A^TWA)^{-1}A^TWC \tag{2}$$

where the elements of the matrix are defined as follows $C_i$=the count rate recorded in window i (i=1, . . . , m )

$A_{ij}$=the sensitivity matrix element for window i and element j (j=Ra, Sc, Sb, Ir, and Au, for example)

$W_{ij}$=weights ($W_{i\neq j}=0$, $W_{i=j}=k/C_i$, where k is a constant depending on logging speed), and $M_j$=the elemental concentration of element j The sensitivity matrix elements $A_{ij}$ are preferably determined beforehand in test formations containing known concentrations of each isotope. Elemental concentrations are obtained by solving Eq.(1) for M using a weighted-least-squares (WLS) technique.

Similarly, the gamma ray log can be interpreted using the techniques disclosed in U.S. Pat. No. 4,825,071, which is hereby incorporated by reference in its entirety.

Calculation of a relative distance parameter can greatly enhance the diagnostic capabilities of multiple-tracer logs and can provide information not otherwise apparent from the logs themselves. One technique for determining relative distances is set out in U.S. Pat. 4,825,073, which is incorporated herein in its entirety. The relative distance parameter is determined using a simple physical model that shows how relative distance values are obtained from gamma-ray spectroscopy data when multiple isotopes are present. The model is calibrated on the basis of data collected from a test formation in the laboratory.

Figure 2:
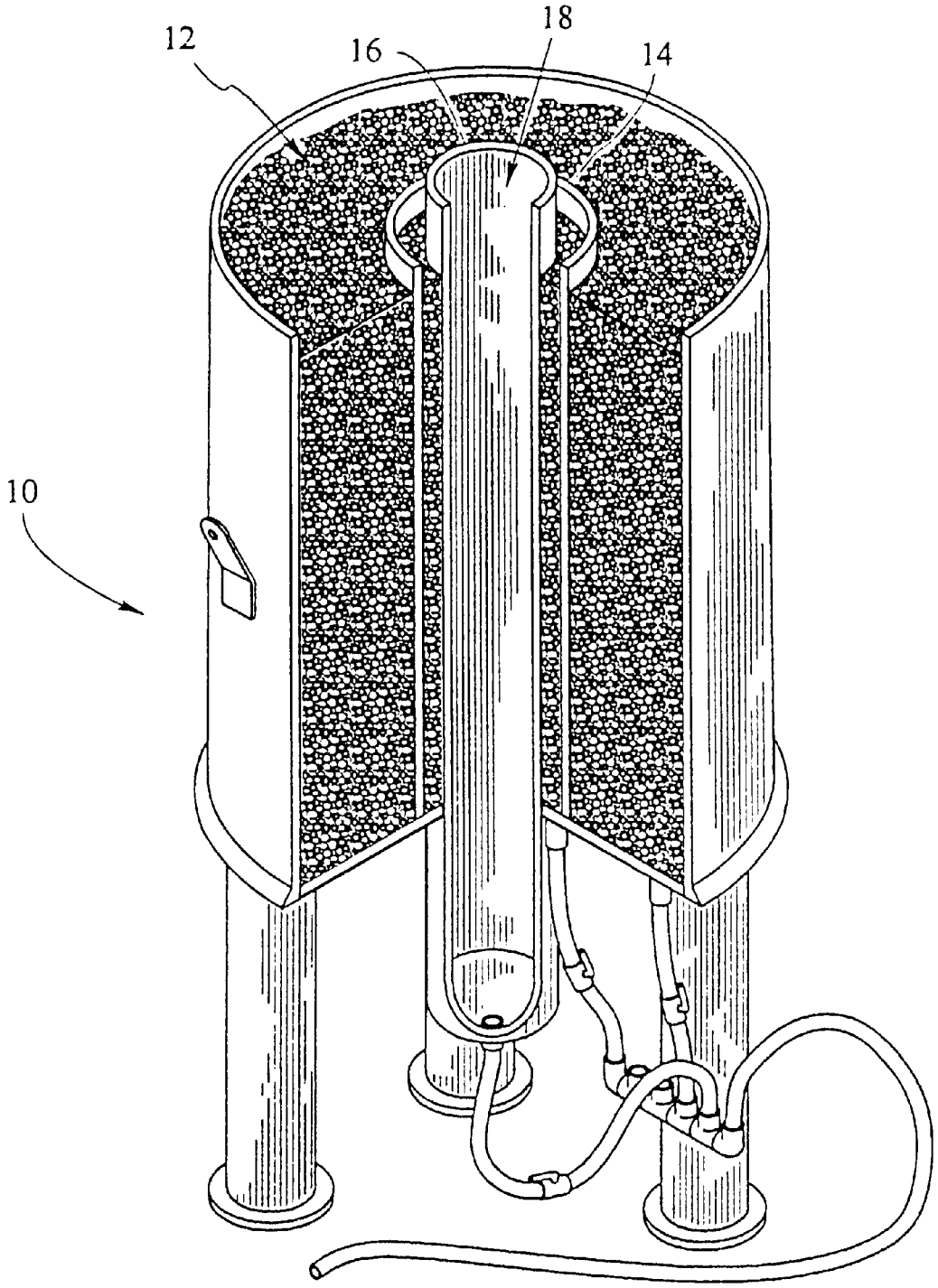
FIG. 2 perspective view showing a test formation for tracer calibration.

An example of such a test formation 10 is shown in FIG. 2. The test formation 10 is preferably constructed so as to include an annular formation 12, a cement annulus 14, a casing 16 and a central borehole 18. The calibration procedure entails pumping tracer-tagged water into the pore spaces of the various individual annuli and into the borehole casing and making measurements with different spectroscopy tools. Because the actual fractures containing tagged material are relatively narrow and the proppant in the fracture is similar to the actual formation matrix, the physics of gamma-ray transport is approximately the same as when the tagging agent is uniformly distributed around the measuring tool.

Figure 3:
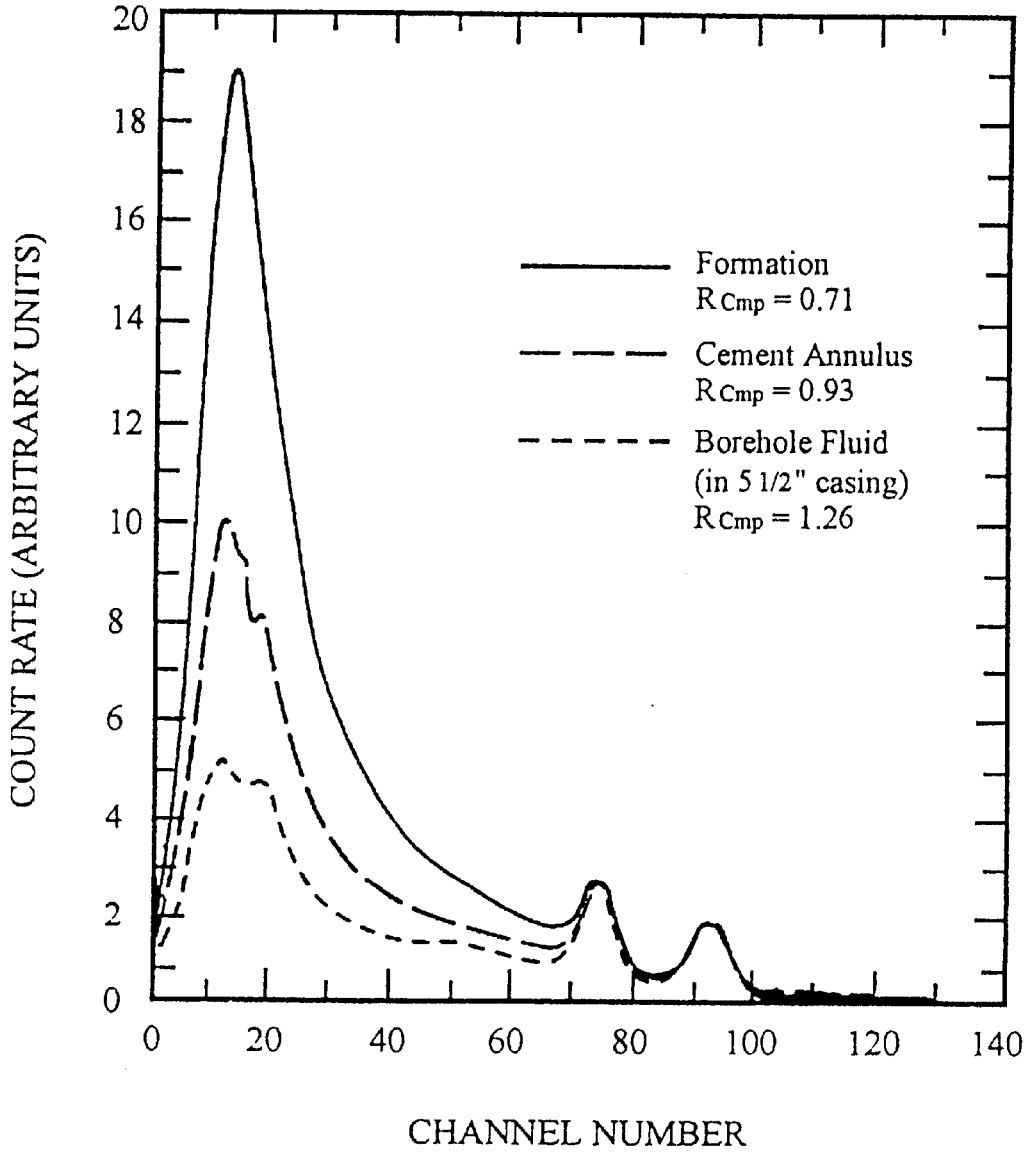
FIG. 3 is a plot showing $^{46}Sc$ spectral signatures from different locations showing Compton scattering effects.

By way of example only, spectral signatures for $^{46}Sc$ for the three different annuli of FIG. 2 are shown in FIG. 3. These signatures demonstrate the relative increase in the low-energy part of the spectrum from the Compton-scattering effect as the distance between the tracer and the detector increases. The region inside the borehole casing is the borehole component and the formation outside the cement annulus is the formation component. The WLS algorithm assumes that only borehole and formation regions contain tracers. Experience has shown that any other distribution can be well approximated by a linear combination of these two components. Thus, as discussed above, the composite spectrum obtained by summing the borehole and formation contributions for each isotope can be used to determine the apparent Compton ratio for that isotope from the WLS analysis of the gamma-ray spectroscopy log data, even when more than one isotope is present.

The relationship between the Compton ratio, $R_{Cmp}$, and the diameter D of an annulus containing a tracer that emits gamma rays, may be expressed by the following equation:

$$R_{Cmp}=A+B/D^2, \tag{2}$$

where A and B are parameters that vary according to radionuclide type and the specific borehole geometry. Variations on this equation will be obtained, depending on the mathematical analysis used and the particular parameters of each well analysis. The processing algorithm solves Equation (2) for D to obtain a diameter estimate. This diameter measurement is affected by field borehole geometries and tracer distributions that are different from the laboratory test formation and by statistical variations in the measurements.

Interpretation of Results

Once the concentration and Compton ratio for radium in the borehole are obtained sufficient information is available to allow an accurate estimation of the position and quantity of radioactive scale in the hole.

While a preferred embodiment of the invention has been shown and described, modifications thereof can be made by one skilled in the art without departing from the spirit of the invention.

What is claimed is:

1. A method for assessing the presence of scale in equipment that is downhole in a well from data gathered in a single logging pass following placement of radioactive tracers in the hole, comprising:

(a) logging a desired portion of the hole so as to obtain gamma ray spectral data;

(b) providing a first matrix of sensitivities corresponding to the emission of gamma rays from scale in the downhole equipment;

(c) using the first matrix of sensitivities in performing a weighted-least-squares analysis of the spectral data from the log to calculate the amount of radioactive radium in the hole.

2. The method according to claim 1, further including the step of calculating the amount of scale in the equipment in the hole from the amount of radium calculated in step (c).

3. The method according to claim 1, further including the steps of providing a second matrix of sensitivities corresponding to the emission of gamma rays from a second radioactive isotope and using the second predetermined matrix of sensitivities to perform a weighted-least-squares analysis of data from the log to calculate the amount of the second radioactive element.

4. The method according to claim 3, further including the steps of providing a third matrix of sensitivities corresponding to the emission of gamma rays from a third radioactive isotope and using the third predetermined matrix of sensitivities to perform a weighted-least-squares analysis of data from the log to calculate the amount of the third radioactive element.

5. The method according to claim 4, further including the steps of providing a fourth matrix of sensitivities corresponding to the emission of gamma rays from a fourth radioactive isotope and using the fourth predetermined matrix of sensitivities to perform a weighted-least-squares analysis of data from the log to calculate the amount of the fourth radioactive element.

6. A method for logging a well containing downhole equipment when the well has had radioactive tracers placed in it, comprising:

(a) making a pass through the well with a gamma ray spectroscopy tool so as to collect gamma ray spectral data;

(b) using the gamma ray spectral data to calculate the gamma ray energy attributable to the tracers in the hole;

(c) using the gamma ray spectral data to calculate the gamma ray energy attributable to radium in the hole; and (d) using the measurement calculated in step (c) to determine the amount of scale present in downhole equipment in the hole.

7. The method according to claim 6 wherein the number of tracers is at least three.

8. The method according to claim 6 wherein the number of tracers is at least four.

9. The method according to claim 6 wherein the tracers are selected from the group consisting of iridium ($^{192}$Ir), antimony ($^{124}$Sb), gold ($^{198}$Au), iodine ($^{131}$I) and scandium ($^{49}$Sc).

10. A method for logging a well containing downhole equipment, comprising:

(a) making a pass through the well with a gamma ray spectroscopy tool so as to collect gamma ray spectral data;

(b) using the gamma ray spectral data to calculate a log of the total gamma ray energy in the hole;

(c) using the gamma ray spectral data to calculate the gamma ray energy attributable to radioactive scale in the downhole equipment in the hole; and (d) subtracting the gamma ray energy attributable to radioactive scale in downhole equipment in the hole from the total gamma ray energy in the hole to give a log of the gamma ray energy attributable to other radioactive elements in the hole.

11. The method according to claim 10, further including the step of (e) placing material containing at least one radioactive tracer in the hole prior to performing step (a).

12. The method according to claim 11 wherein the tracer is selected from the group consisting of iridium ($^{192}$Ir), antimony ($^{124}$Sb), gold ($^{198}$Au), iodine ($^{131}$I) and scandium ($^{49}$Sc).

13. The method according to claim 11 wherein the number of radioactive tracers placed in the hole is at least two.

14. The method according to claim 11 wherein the number of radioactive tracers placed in the hole is at least three.

* * * * *